US007278671B1

(12) United States Patent
Herford

(10) Patent No.: US 7,278,671 B1
(45) Date of Patent: Oct. 9, 2007

(54) DEVICE FOR GRASPING LOAD STRUCTURE

(76) Inventor: Edwin Dennis Herford, 171 N. Main St., Elkton, MI (US) 48731

( * ) Notice: Subject to any disclaimer, the term of this patent is extended or adjusted under 35 U.S.C. 154(b) by 0 days.

(21) Appl. No.: 11/379,851

(22) Filed: Apr. 24, 2006

(51) Int. Cl.
*B66C 1/28* (2006.01)

(52) U.S. Cl. ..... 294/110.1; 294/112

(58) Field of Classification Search ..... 294/110.1, 294/90, 104, 106, 112, 95, 97, 98
See application file for complete search history.

(56) References Cited

U.S. PATENT DOCUMENTS 1,159,680 A * 11/1915 Johns ..... 294/110.1
1,306,206 A * 6/1919 Waknitz ..... 294/112
2,576,193 A 11/1951 Reynolds
2,610,889 A * 9/1952 Penn ..... 294/97
2,756,089 A * 7/1956 Meloy ..... 294/31.1
2,916,322 A * 12/1959 Wirkkala ..... 294/112
3,089,726 A * 5/1963 Letourneau ..... 294/88
3,339,966 A 9/1967 Carlson
3,915,488 A * 10/1975 Anderson ..... 294/90
4,359,241 A 11/1982 Kistner
4,653,728 A 3/1987 Mochizuki et al.
5,303,968 A 4/1994 Trine
5,306,062 A 4/1994 Dodge
5,342,104 A 8/1994 Sato et al.
5,476,300 A 12/1995 Dodge
5,618,075 A 4/1997 Baziuk
5,660,422 A 8/1997 Knisley
5,999,584 A 12/1999 Adams et al.
6,019,403 A 2/2000 Corbett
6,609,742 B1 8/2003 Macom et al.
6,789,827 B2 9/2004 Webster et al.
6,869,249 B2 3/2005 Calhoon

* cited by examiner

*Primary Examiner*—Dean J Kramer
(74) *Attorney, Agent, or Firm*—Seyfarth Shaw LLP

(57) ABSTRACT

A device for grasping a load structure while it is being lifted, moved or lowered, comprising first, second and third legs, each extending radially outwardly from a vertical axis and adapted to pivotally engage a pivot member. The first, second and third legs are each adapted to pivot between an engaged position and a released position, and an urging member urges the legs toward the engaged position.

6 Claims, 4 Drawing Sheets

DEVICE FOR GRASPING LOAD STRUCTURE

BACKGROUND OF THE INVENTION

The present invention relates to a device for grasping load structures and more particularly, to a device for grasping utility sections such as the castings and riser rings used in municipal drains while they are being lifted, moved or lowered.

Many construction projects involving municipal storm and sewer drains require the setting of iron castings above manholes. In setting a casting, workers must ensure that the casting is properly graded with the ground surface. As such, workers adjust the elevation of the casting by placing a concrete riser ring of appropriate height, typically between four and twelve inches, in order to grade the casting.

Because riser rings and castings generally weigh between 100 and 500 pounds, it is desirable to lift such load structures using a lifting device such as an overhead crane or the like. Traditionally, workers would use chains to rig the load structure to the lifting device.

There are many drawbacks associated with using chains and similar grasping devices to lift or move drain sections such as castings and riser rings. While the lifting equipment provides the lifting force, many of the tasks in setting the load structure require manual force. For example, in using chains, the load structure may tilt off the level plane making it difficult to accurately position the load structure as it is being lowered. In this scenario, manual force is required to slide the load structure into the correct position. This is also dangerous because the worker who manually moves the load structure risks serious injury if the load structure become unstable and falls.

Further, previous grasping devices, such as chains, grasp the load structure from the inside, thereby requiring workers to step inside the load structure and manually lift it to remove the chains once the load structure has been lowered. Therefore, the problems associated with using traditional grasping devices, such as chains, can lead to fatigue and injury and often requires the use of two or more workers.

BRIEF SUMMARY OF THE INVENTION

The present invention relates to a device for grasping load structures and more particularly, to a device for grasping utility sections such as the castings and riser rings used in municipal drains while they are being lifted, moved or lowered. The claimed grasping device is durable and efficient to use, having a simple design that minimizes the number of members and joints. The grasping device is adapted to be coupled to lifting equipment, such as an overhead crane or the like. Furthermore, the grasping device enables the load structure to be set by a single worker and minimizes the number of tasks requiring manual force by that worker.

In an embodiment, a first leg, a second leg and a third leg extend substantially radially from a vertical axis. The first and second legs include pivot portions at one end, permitting pivotal engagement with a pivot member, and lift portions at the respective opposing ends. An extender may be welded between the pivot portions of the first and second legs. The extender includes a shaft and a lower end coupled to a urging member such as a spring.

The third leg includes a pivot portion for pivotal engagement with the pivot member whereby the third leg may pivot between an engaged position, where the third leg is pivoted toward the vertical axis, wherein the device is adapted to engage a load structure, and a released position where the third leg is pivoted away from the vertical axis. The urging member creates a moment on the third leg and the extender, which urges the grasping device toward the engaged position.

BRIEF DESCRIPTION OF THE DRAWINGS

For the purpose of facilitating an understanding of the subject matter sought to be protected, there is illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION OF THE PREFERRED EMBODIMENT

Figure 1:
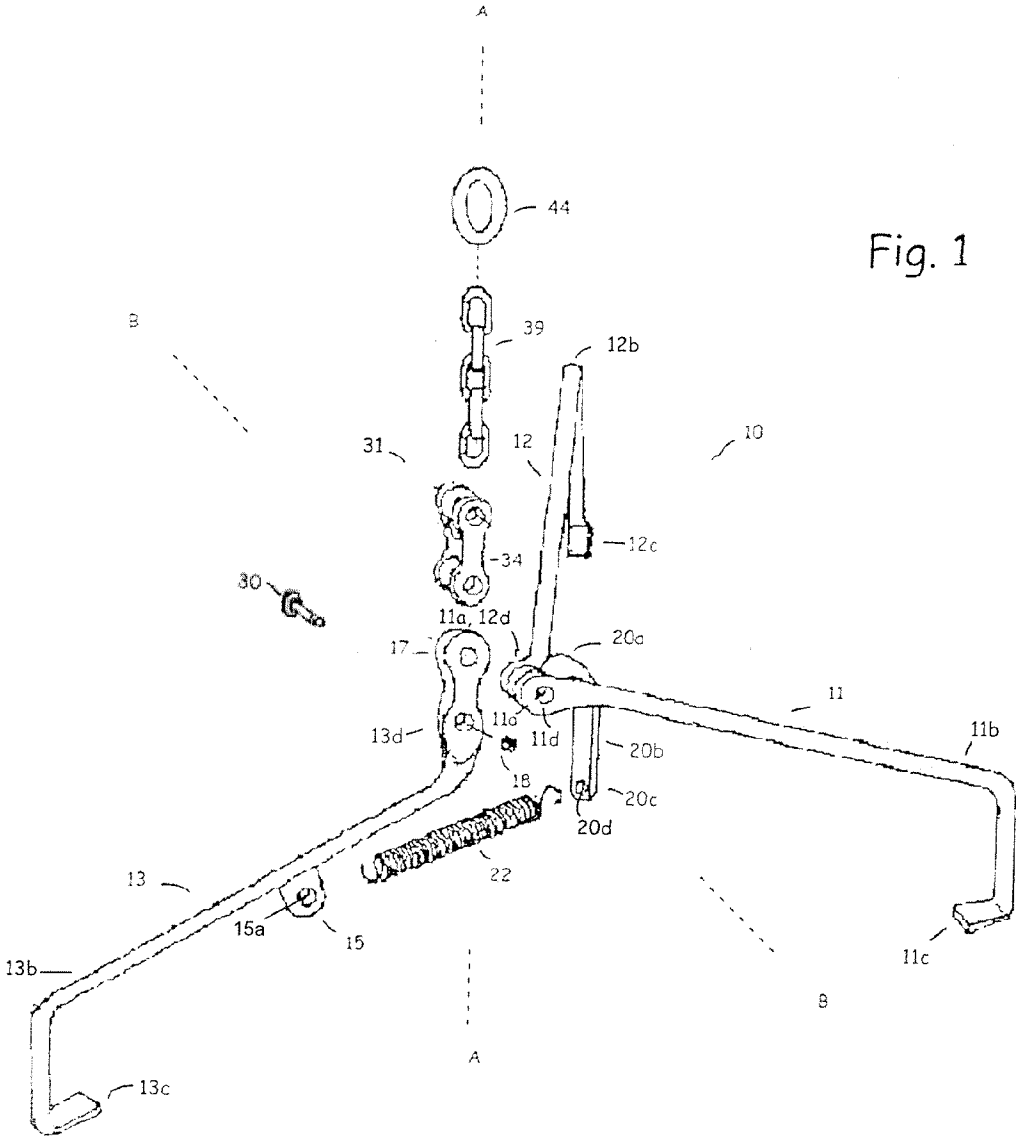
FIG. 1 is a perspective, exploded view of an embodiment of the grasping device of the present application in a disassembled state.

Referring to FIG. 1, an embodiment of the grasping device of the present application generally referred to as numeral 10, is shown. The embodiment includes a first leg 11, a second leg 12 and a third leg 13. Each leg 11, 12, 13 respectively includes arms 11*b*, 12*b*, 13*b* with respective pivot portions 11*a*, 12*a*, 13*a* at first ends thereof. The opposing ends of the arms 11*b*, 12*b*, 13*b* respectively include lift portions 11*c*, 12*c*, 13*c*, which may be in the form of depending feet that are substantially parallel to vertical axis A-A and adapted to engage a bottomside of a load structure 50. It will be appreciated that while the present invention has been described with only three legs, alternate embodiments having four or more legs are possible without departing from the true scope and spirit of the present application. The legs 11, 12, 13 are preferably substantially rigid and of one-piece construction, fabricated from either round or square steel stock, but may also be forged or cast in aluminum, steel, iron, or any combination thereof.

The pivot portions 11*a*, 12*a*, 13*a* include respective apertures 11*d*, 12*d*, 13*d* adapted for pivotal engagement about a pivot member 30, disposed along a pivot axis B-B. The pivot member 30 may be in the form of a bolt or pin having a free end that is adapted to threadably engage a nut 18. The pivot portions 11*a*, 12*a*, 13*a* permit pivotal engagement with the pivot member 30, whereby the legs 11, 12, 13 may pivot about the pivot axis B-B between an engaged position, where the legs 11, 12, 13 are pivoted inwardly and substantially toward the vertical axis A-A wherein the device is adapted to engage or grasp a load structure, and a released position, where the legs 11, 12, 13 are pivoted outwardly and substantially away from the vertical axis A-A. It will appreciated that the pivot portions 11*a*, 12*a*, 13*a* are disposed substantially parallel in a direction that is substantially perpendicular to the pivot axis B-B in order to permit pivotal engagement with the pivot member 30.

Figure 2:
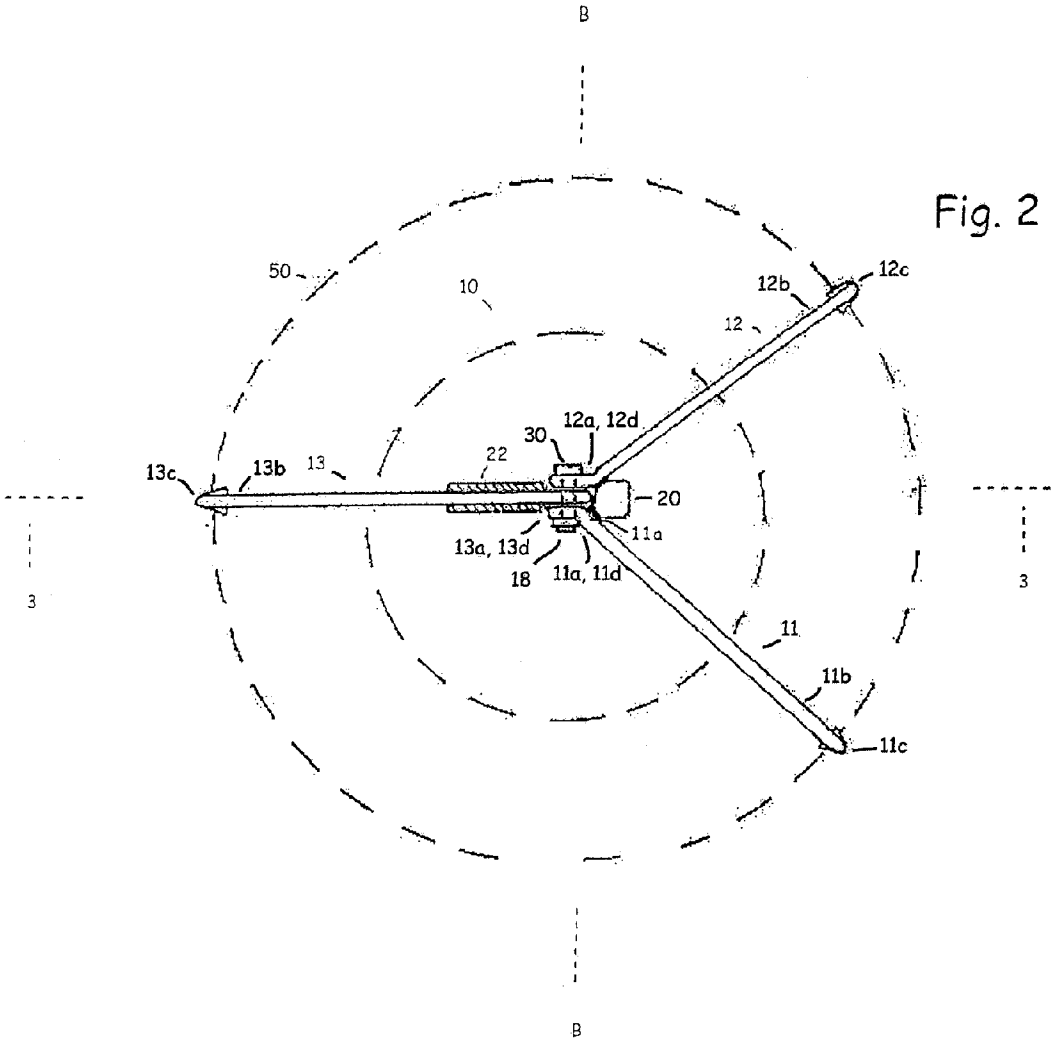
FIG. 2 is an enlarged plan view of an embodiment of the grasping device of the present application being used to grasp a load structure shown in dotted lines.

Referring to FIG. 2, the arms of the first and second legs 11*b*, 12*b* may be angled at reciprocally equivalent obtuse angles relative to the pivot portions 11*a*, 12*a*. As such, the arms 11*b*, 12*b* are equally spaced relative to arm of the third leg 13*b*, thereby ensuring that the weight of the load structure being lifted is distributed evenly between legs 11, 12, 13 during operation.

Figure 3:
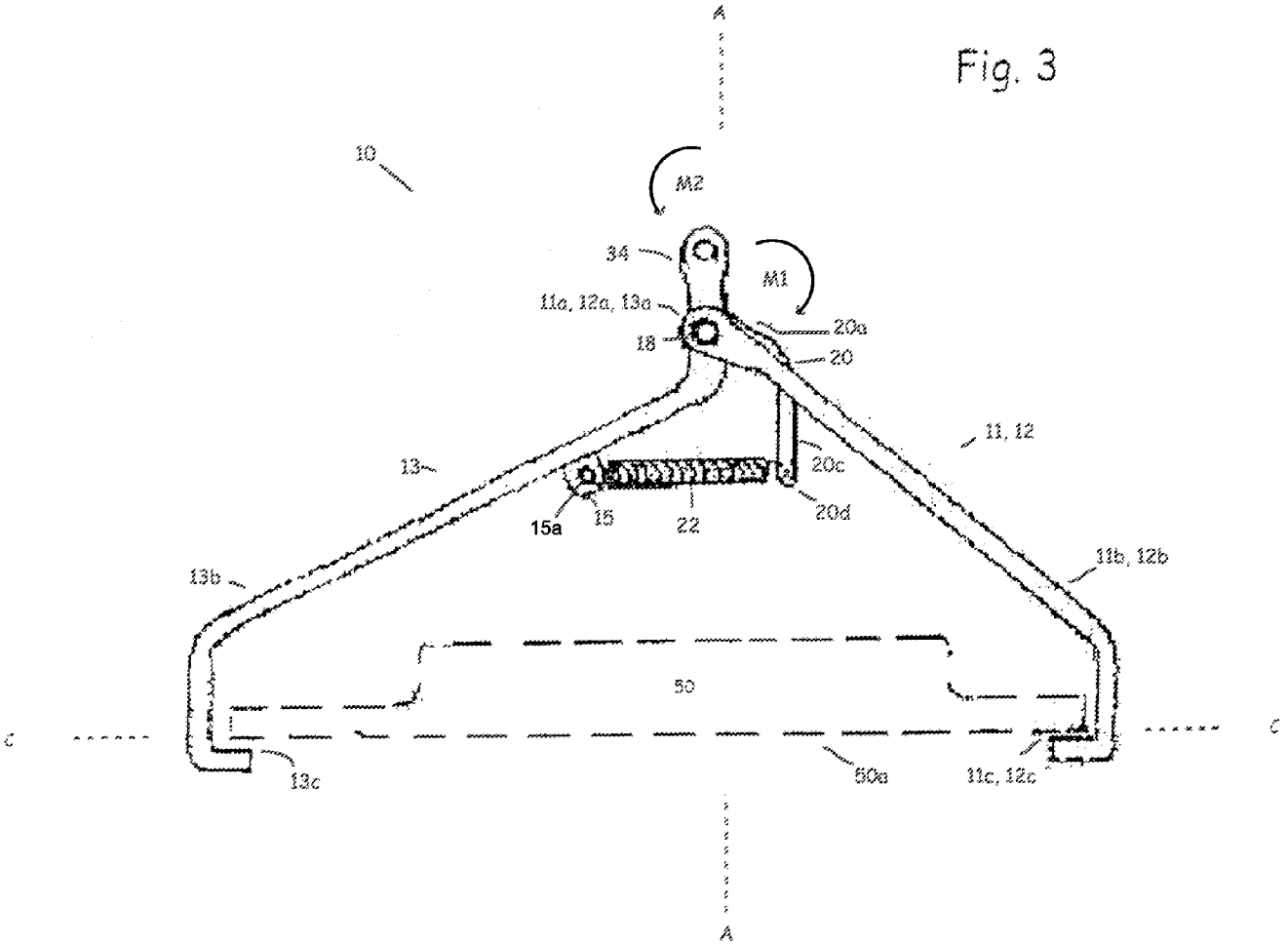
FIG. 3 is an enlarged cross-sectional view of the grasping device of FIG. 2, taken generally along line 3-3 of FIG. 2.
Figure 4:
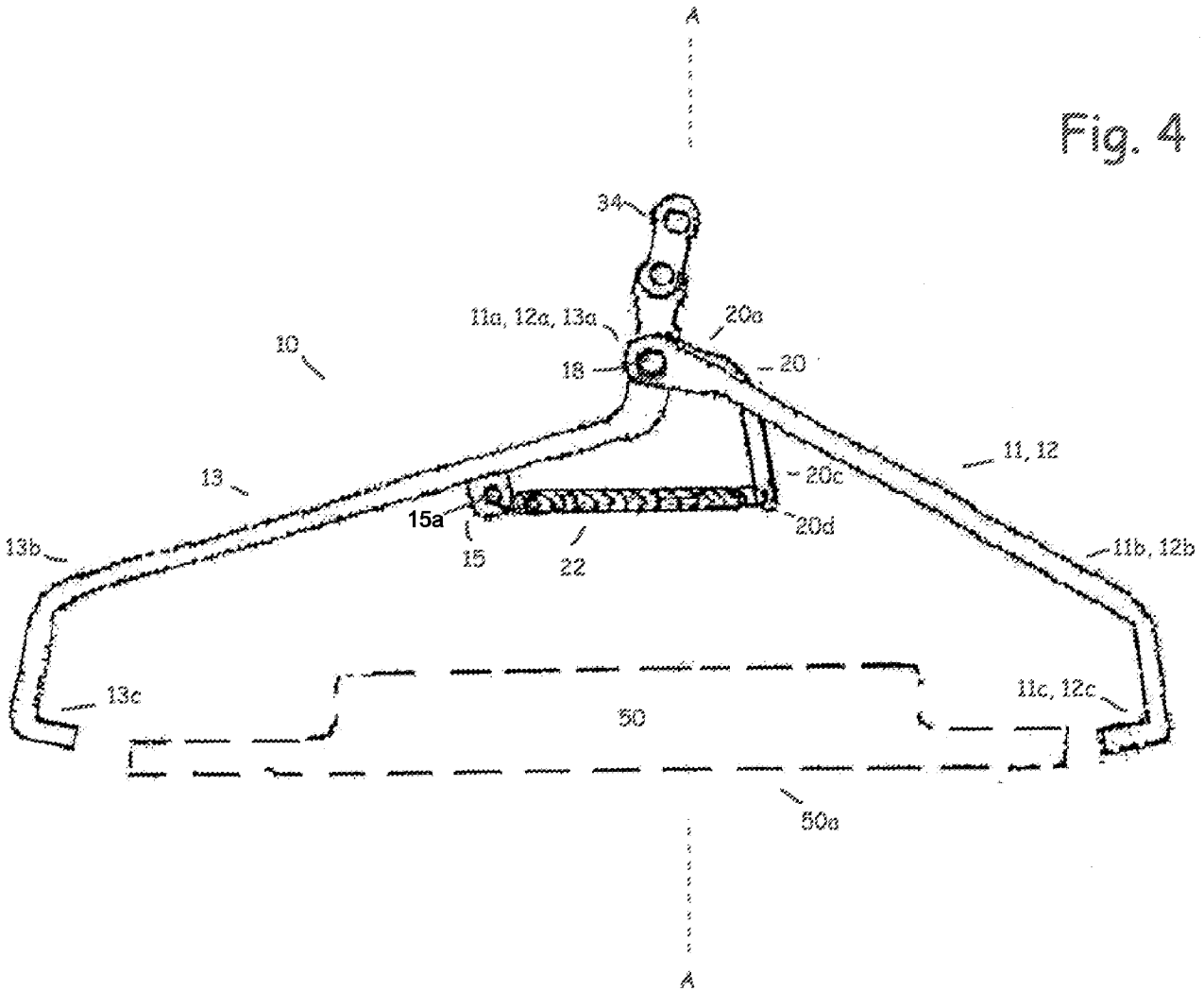
FIG. 4 is a view similar to FIG. 3, but showing the grasping device in the released position.

Referring also to FIGS. 3-4, the lift portions 11*c*, 12*c*, 13*c* extend from arms radially inwardly relative to the vertical axis A-A and are disposed along a lifting plane C-C that is substantially perpendicular to the vertical axis A-A. The lift portions 11*c*, 12*c*, 13*c* may be formed as a ledge, resting surface, or foot adapted to engage the underside of a load structure 50, such as a casting or a riser ring, such that the load remains secured and level while it is being moved.

An extender 20 has an end 20*a* that is fastened, through welding or through other well-known means, to the first and second legs 11, 12 substantially adjacent to the pivot portions 11*a*, 12*a*, but not overlapping the apertures 11*d*, 12*d*, 13*d* (see FIG. 2). The extender 20 includes a depending shaft 20*b* extending substantially parallel to the vertical axis A-A, and a lower end 20*c* having an aperture 20*d* that is adapted to be coupled to an urging member 22, such as a spring or the like.

An eyelet 15 is welded or otherwise coupled to the third leg 13 between the pivot portion 13*a* and the lift portion 13*c*. The eyelet 15 has an aperture 15*a* adapted to be coupled to the urging member 22. In an embodiment, the urging member 22 urges the extender 20 toward the eyelet 15, thereby pulling the first, second and third legs 11, 12, 13 inwardly towards the engaged position, as shown in FIGS. 2-3.

Disposed above the pivot portion of the third leg 13 is a second aperture 17 adapted to be coupled to a hoist assembly 31, in a well-known manner. The hoist assembly may include, for example a link 34, chain 39 and ring 44, arranged in a well known manner. The ring 44 is adapted to be coupled to a hoist cable (not shown) of a lifting device such as a crane, forklift or the like.

Referring also to FIGS. 2-4, operation of the grasping device 10 is shown. To cause the grasping device 10 to engage the load structure 50, the worker (not shown) may manually grip one of the first and second legs 11, 12 in one hand, grip the third leg 13 in the other hand, and spread the legs 11, 12, 13 towards the released position, thereby causing tension in the urging member 22 as shown in FIG. 4. Holding the grasping device 10 in the released position, the worker manually positions the lift portions 11*c*, 12*c*, 13*c* such that they engage the underside load structure 50*a*. Next, the worker rigs the hoist assembly 31 to a hoist cable. As the load structure 50 is lifted and the weight of the load structure 50 transfers to the grasping device 10, the urging member 22 ensures that the grasping device 10 remains in the engaged position such that the load structure 50 remains secured. Furthermore, it will be appreciated that as the load structure 50 is being lifted, the weight of the load structure 50 results in a first moment M1 on the first and second legs 11, 12 and a second moment M2 on the third leg 13, which further causes the legs 11, 12, 13 to remain in the engaged position during movement. In that regard, the mass of the load structure results in a force being applied to the lift portions 11*c*, 12*c*, 13*c* in the direction of gravity, creating a first moment M1 on the first and second legs 11, 12 about the pivot member 30 and a second moment M2 on the third leg 13 about the pivot member 30 as shown in FIG. 3. Next, the worker uses a lifting device, such as an overhead crane, to move the load structure 50 toward its desired location. Finally, as shown in FIG. 4, the worker disengages the grasping device 10 by manually pivoting each leg 11, 12, 13 toward the released position.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A device having a vertical axis for grasping a load structure having weight and an underside comprising:

a pivot member;

a first leg, a second leg and a third leg, each leg extending substantially radially from the vertical axis, each leg adapted to pivotally engage the pivot member and thereby pivot between an engaged position and a released position;

the legs being configured to distribute the weight of the load structure substantially evenly among each of the legs during operation;

an urging member for urging the legs toward the engaged position and;

an extender having one end that is coupled to the first and second legs and another end that is adapted to be coupled to the urging member.

2. The device of claim 1 where the pivot member is a bolt.

3. The device of claim 1 where the first, second and third leg each have respective lift portions at first ends thereof, wherein the lift portions are respectively adapted to engage the underside of the load structure.

4. The device of claim 3 where the lift portions include first portions extending substantially radially inwardly and disposed along a lifting plane that is substantially perpendicular to the vertical axis.

5. The device of claim 1 wherein each leg is substantially rigid and of one-piece construction.

6. A device for grasping a load structure having weight and an underside while the structure is being lifted, moved or lowered, comprising:

a pivot member;

a first leg, a second leg and a third leg, each extending radially outwardly from the vertical axis and having respective pivot portions adapted to pivotally engage the pivot member and respective lift portions that are adapted to engage the underside of the load structure;

the legs being configured to distribute the weight of the load structure substantially evenly among each of the legs during operation;

a downwardly extending extender having one end that is coupled to the first and second legs at a first end thereof, and an urging member with first and second ends, the first end coupled to the extender at a second end thereof and the second end of the urging member coupled to the third leg, whereby the urging member urges the first, second and third legs to pivot substantially inwardly toward the vertical axis.

* * * * *